US005229817A

United States Patent [19]

Lange et al.

[11] Patent Number: 5,229,817

[45] Date of Patent: Jul. 20, 1993

[54] APPARATUS FOR MONITORING WEAR OF A TONER REMOVAL DEVICE

[75] Inventors: Clark V. Lange, Ontario; Robert P. Siegel, Penfield, both of N.Y.

[73] Assignee: Xerox Corporation, Stamford, Conn.

[21] Appl. No.: 858,469

[22] Filed: Mar. 27, 1992

[51] Int. Cl.[5] ..... G03G 21/00

[52] U.S. Cl. ..... 355/209; 355/296; 355/301

[58] Field of Search ..... 340/540, 664, 679; 364/474.17; 73/1 C; 355/200, 203-207, 208, 209, 296, 301; 118/652

[56] References Cited

U.S. PATENT DOCUMENTS

| | | | |
|---|---|---|---|
| 3,989,372 | 11/1976 | Davidge et al. | 355/301 |
| 4,358,974 | 11/1982 | Sakurai | 364/474.17 X |
| 4,551,808 | 11/1985 | Smith et al. | 364/474.17 |
| 4,819,026 | 4/1989 | Lange et al. | 355/298 |
| 4,937,633 | 6/1990 | Ewing | 355/299 |
| 4,967,238 | 10/1990 | Bares et al. | 355/296 |
| 4,977,775 | 12/1990 | Grabovac et al. | 73/1 C |
| 4,982,230 | 1/1991 | Ogura et al. | 355/206 |
| 5,066,978 | 11/1991 | Watarai | 355/206 |
| 5,084,875 | 1/1992 | Weinberger et al. | 355/205 X |
| 5,101,233 | 3/1992 | Ito et al. | 355/209 |

FOREIGN PATENT DOCUMENTS 0196374 8/1988 Japan .

*Primary Examiner*—A. T. Grimley
*Assistant Examiner*—Robert Beatty
*Attorney, Agent, or Firm*—Gary B. Cohen

[57] ABSTRACT

In accordance with the present invention, there is provided a cleaning apparatus in a printing apparatus of the type having a charge retentive surface upon which residual material is disposed. In one aspect of the disclosed embodiment, the cleaning apparatus includes a rotatable member adapted to contact the charge retentive surface for removing the residual material therefrom, and a motor for rotating the rotatable member. The cleaning apparatus further includes a motor controller for transmitting an electrical signal to the motor, and a machine controller for monitoring the electrical signal to measure the extent of wear to which the rotatable member has been subjected. In another aspect of the disclosed embodiment, the cleaning apparatus includes a conductive cleaning member, disposed proximate the charge retentive surface, for generating an electrostatic field to remove the residual material from the charge retentive surface. Additionally, there is provided a power supply for transmitting an electrical signal to the conductive cleaning member, and an electrical circuit for monitoring the electrical signal to measure the extent of wear to which the conductive cleaning member has been subjected.

15 Claims, 3 Drawing Sheets

APPARATUS FOR MONITORING WEAR OF A TONER REMOVAL DEVICE

The present invention relates generally to a cleaning apparatus for removing residual toner from a charge retentive surface and more particularly to an apparatus and method capable of monitoring the wear to which the cleaning apparatus has been subjected.

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface from an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development and transfer, excess toner left on the charge retentive surface is cleaned from the surface. The process is well known, and useful for light lens copying from an original, and printing applications from electronically generated or stored originals, where a charged surface may be imagewise discharged in a variety of ways.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin, and other debris have a tendency to be attracted to the charge retentive surface. It is essential for optimum operation that the toner remaining on the surface be cleaned thoroughly therefrom.

A commercially successful mode of cleaning employed in automatic xerography utilizes a brush with soft fiber bristles which have suitable triboelectric characteristics. While the bristles are soft they are sufficiently firm to remove residual toner particles from the charge retentive surface. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon, also rely on electrostatic fields established by electrically biasing one or more members in a cleaning system.

It has been found that establishing an electrostatic field between the charge retentive surface and the cleaning member such as a fiber brush or a magnetic brush enhances toner attraction to the cleaning brush surface. Biased detoning devices, which may be used to remove toner, are discussed in the following patent:

U.S. Pat. No. 4,819,026; Patentee: Lange et al.; Issued: Apr. 4, 1989.

With cleaning members for removing residual toner, a cleaning relationship is established between the cleaning member and the charge retentive surface so that the cleaning member substantially contacts the charge retentive surface to remove residual toner therefrom. In various applications, the ability of the cleaning member to remove residual toner directly correlates to the extent to which it contacts the charge retentive surface. After a certain amount of use, the ability of the cleaning member to remove residual toner from the charge retentive surface diminishes beyond an acceptable level. In practice, this problem is solved by defining an average life of the cleaning member in terms of a predetermined copy count and replacing the cleaning member at a "first service call after" the predetermined copy count. This approach does not accommodate for property variations in cleaning members of the same type. That is, even cleaning members of the same type do not invariably have exactly the same properties and do not wear equivalently even in the same environment. Additionally, variations in environment and usage tend to impact the life expectancy of a given cleaning member. The following patents disclose alternative approaches to simply replacing the cleaning member at the "first service call after":

U.S. Pat. No. 4,937,633; Patentee: Ewing; Issued: Jun. 26, 1990.

U.S. Pat. No. 4,967,238; Patentee: Bares et al.; Issued: Oct. 30, 1990.

U.S. Pat. No. 4,937,633 discloses an elastomeric cleaning blade supported in cleaning relationship with an imaging surface of an electrophotographic device, for releasing residual toner from its tenacious adherence to the imaging surface. Since the blade releases the residual toner, rather than removing it, the cleaning blade is commonly used in conjunction with removing means to remove the released residual toner. The cleaning blade defines a cleaning edge having electrical characteristics which vary when an electrical signal is applied thereto. Changes in the electrical characteristics of the cleaning blade edge serve to indicate cleaning blade edge failure, or impending failure.

U.S. Pat. No. 4,967,238 discloses an arrangement for detecting toner or debris deposits on an imaging surface in a printing apparatus with a cleaning station. The arrangement, which includes a light source and a light intensity detecting sensor arrangement, is positioned downstream of the cleaning station. In operation, the imaging surface is illuminated with the light source, the illuminated surface is viewed with the light intensity detecting sensor arrangement to produce a signal representative of detected light intensity and a response signal, indicative of the condition of the surface, is produced.

For a removing arrangement including a movable cleaning member, such as cleaning brush having bristles, the bristles tend to "set" or bend after a given period of use so that a contact zone defined between the bristles and the charge retentive surface tends to decrease and thus diminish the brush's ability to remove residual toner. It would be desirable to provide the removing arrangement with the capacity to monitor the movable cleaning member for determining the extent of wear to which the movable cleaning member has been subjected.

In accordance with the present invention, there is provided a cleaning apparatus adapted for use in a printing apparatus of the type having a charge retentive surface upon which residual material is disposed.

In a first aspect of the disclosed embodiment, the cleaning apparatus comprises a rotatable member adapted to contact the charge retentive surface for removing the residual material therefrom, and means, coupled to the rotatable member, for rotating the rotatable member. The cleaning apparatus further comprises means for transmitting an electrical signal to the rotating means, and means for monitoring the electrical signal to measure the extent of wear to which the rotatable member has been subjected.

In one exemplary arrangement of the first aspect of the disclosed embodiment, the rotatable member comprises a brush coupled with a motor, and the electrical signal comprises a current. Additionally, the monitoring means can comprise a measuring device communicating with the motor while the measuring device can comprise a central processing unit capable of detecting the level of current being supplied to the motor.

In a second aspect of the disclosed embodiment, the cleaning apparatus comprises a conductive cleaning member, disposed proximate the charge retentive surface, for generating an electrostatic field to remove the residual material from the charge retentive surface. Additionally, there is provided means for transmitting an electrical signal to the conductive cleaning member, and means for monitoring the electrical signal to measure the extent of wear to which the conductive cleaning member has been subjected.

In one exemplary arrangement of the second aspect of the disclosed embodiment, the conductive cleaning member comprises a brush coupled with a power supply, and the electrical signal comprises a current. Additionally, the monitoring means can comprise a measuring device communicating with the conductive cleaning member while the measuring device can comprise a central processing unit capable of detecting the level of current being supplied from the power supply to the conductive cleaning member.

In a third aspect of the disclosed embodiment, the cleaning apparatus comprises a rotatable cleaning member adapted to contact the charge retentive surface, and a motor, coupled to the rotatable cleaning member, for moving the rotatable cleaning member to mechanically remove the residual material from the charge retentive surface. The rotatable cleaning member is characterized by a torque value as it is moved, and means for monitoring the torque value are provided to detect the extent of wear to which the rotatable cleaning member has been subjected.

In one exemplary arrangement of the third aspect of the disclosed embodiment, the means for monitoring comprises a transducer capable of sensing the amount of torque to which the rotatable cleaning member is subjected and generating a signal indicative of the torque value. Additionally, the monitoring means can further comprise a measuring device, communicating with the transducer, for detecting the level of the signal.

These and other aspects of the invention will become apparent from the following description, the description being used to illustrate a preferred embodiment of the invention when read in conjunction with the accompanying drawings.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 3:
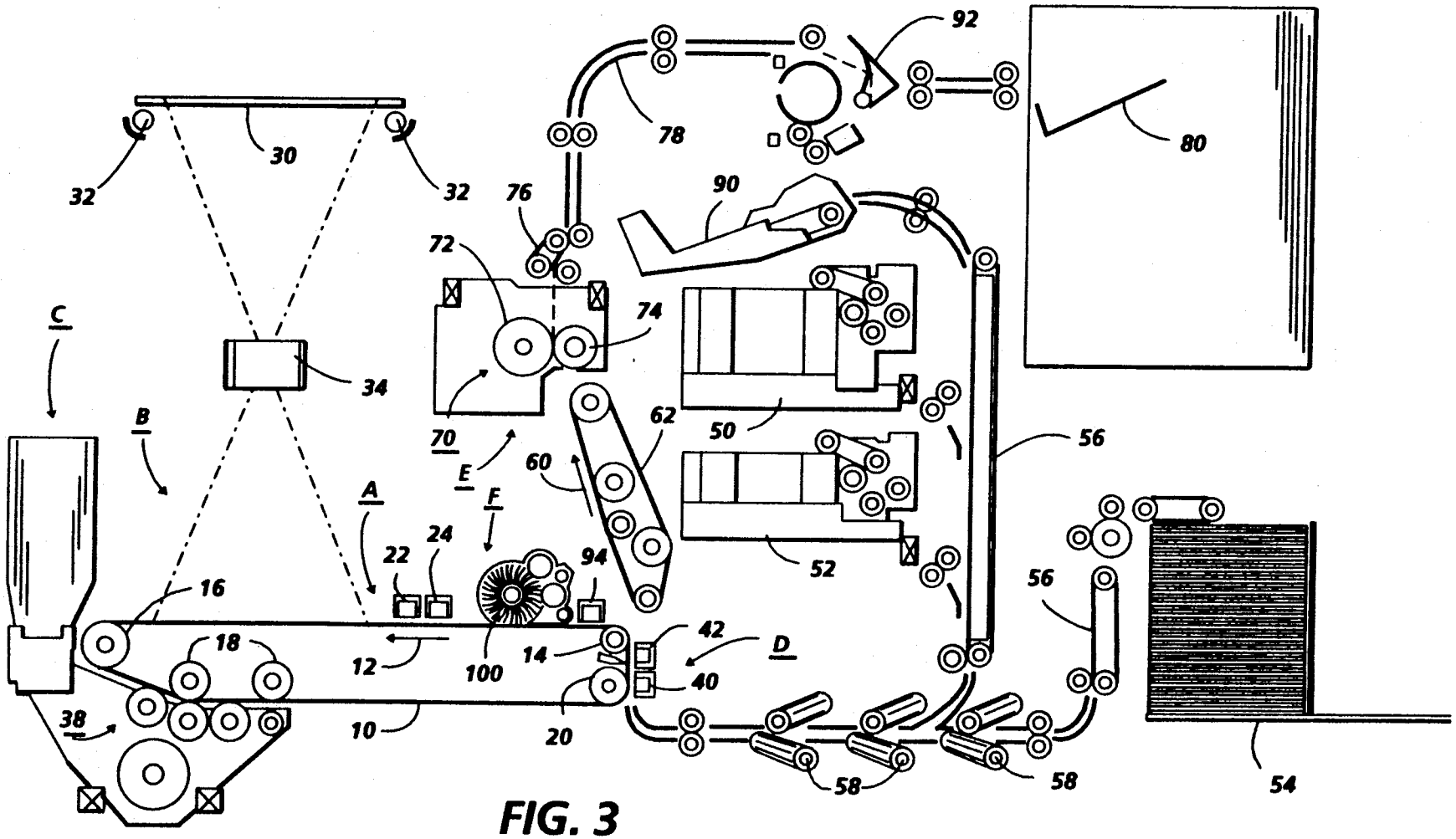
FIG. 3 is a schematic elevational view depicting an electrophotographic printing machine incorporating the present invention.

Referring to FIG. 3, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 12.

With continued reference to FIG. 3, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as a paper copy sheet is moved into contact with the developed latent images on belt 10. First, the latent image on belt 10 is exposed to a pretransfer light from a lamp (not shown) to reduce the attraction between photoreceptor belt 10 and the toner powder image thereon. Next, corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating, etc. and removal from the machine by the operator. Alternatively, the sheet may be advanced to a duplex tray 90 from duplex gate 92 from which it will be returned to the processor and conveyor 56 for receiving second side copy.

A pre-clean corona generating device 94 is provided for exposing the residual toner and contaminants (hereinafter, collectively referred to as toner) to positive charges to thereby narrow the charge distribution thereon for more effective removal at cleaning station F, more completely described hereinafter. It is contemplated that residual toner remaining on photoreceptor belt 10 after transfer will be reclaimed and returned to the developer station C by any of several well known reclaim arrangements, and in accordance with the present invention, described below.

As thus described, a reproduction machine in accordance with the present invention may be any of several well-known devices. Variations may be expected in specific processing, paper handling and control arrangements without affecting the present invention.

Figure 1:
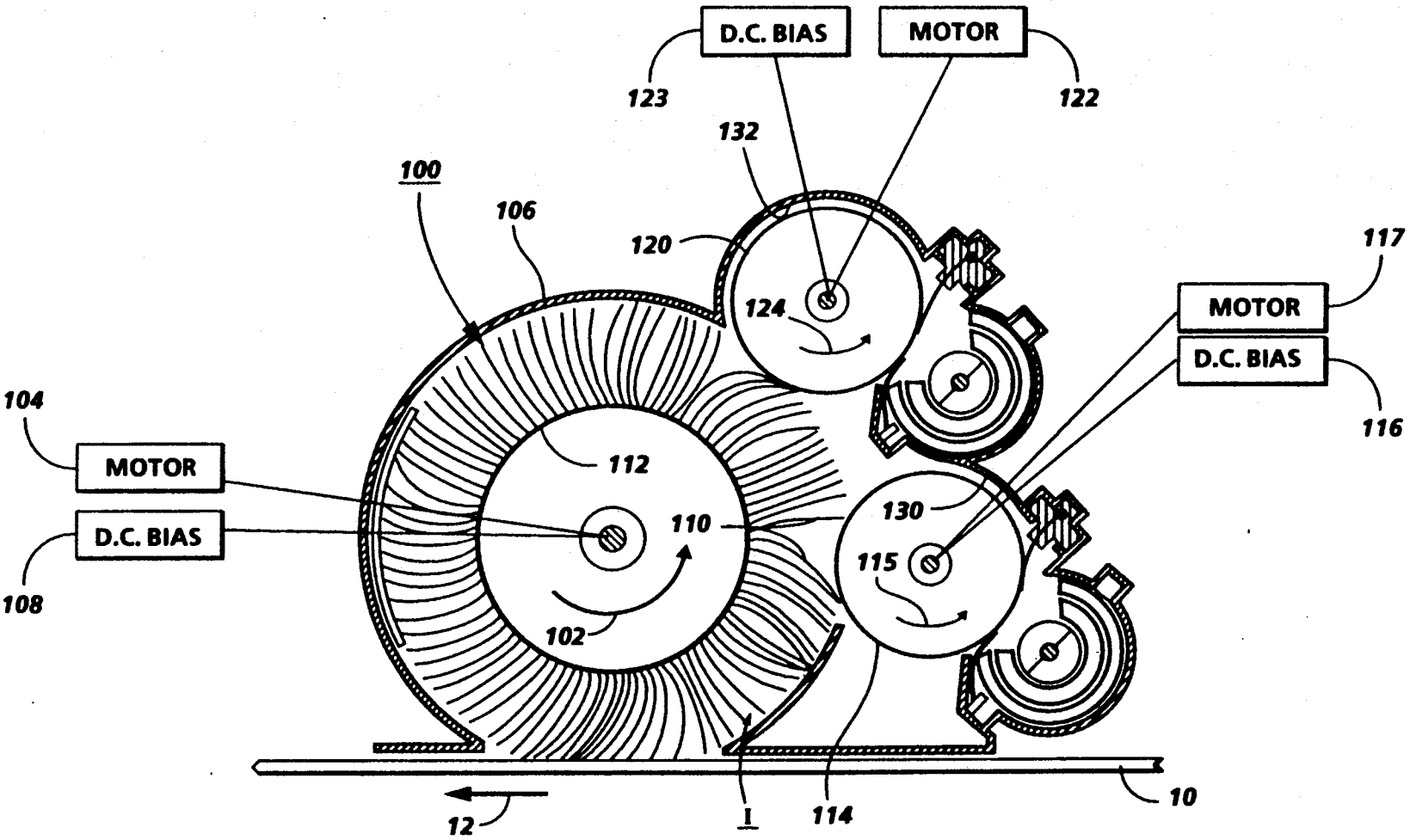
FIG. 1 is a schematic illustration of a cleaning apparatus incorporated in an electrophotographic printing machine of FIG. 3.

Referring to FIG. 1, in one illustrated embodiment of the invention, cleaning station F includes a fiber brush cleaning arrangement having dual detoning rolls for removing residual toner and debris from belt 10. A captive fiber cleaning brush 100 is supported for rotational movement in the direction of the arrow 102 via motor 104, within a cleaning housing 106, and negatively biased by means of a D.C. power source 108. As described in U.S. Pat. No. 3,572,923 to Fisher et al, a fiber brush may advantageously comprise a large number of conductive cleaning fibers 110 supported on a cylindrical conductive member 112. In a preferred embodiment, housing 106 may be economically manufactured in a unitary extrusion, with recesses formed in accordance with component requirements. Residual toner and contaminants or debris such as paper fibers and Kaolin are removed from the photoreceptor belt 10 surface by means of a brushing action of the fibers 110 against belt 10 and the electrostatic charge applied to the fibers from the D.C. power supply 108. In a xerographic system of the type disclosed herein, brush 100 will remove both toner and debris from the photoreceptor, the former having a positive and the latter having a negative charge. Negatively, charged contaminants are removed along with the positively charged toner particles to which they may be adhered.

In the illustrated embodiment, brush fibers 110 bearing toner and debris removed from belt 10 are first contacted by a first detoning roll 114 supported for rotation in the direction of arrow 115, the same direction as brush 100 by means of a motor 116. An electrical bias is supplied to first detoning roll 114 from D.C. power supply 117. In accordance with the invention, detoning roll 114 is supported in operational position against brush 100, closely spaced to the position where brush fibers 110 leave contact with the surface of photoreceptor belt 10. A second detoning roll 120 is provided for further removal of the preponderance of residual toner from the brush at a location spaced along the circumference of the brush. A motor 122 drives the roll in the detection of the arrow 124, the same direction as fiber brush 100 and roll 114. An electrical bias is supplied to the roll 120 from a source of D.C. power 123. Recesses 130 and 132 in cleaning housing 106 are provided for the support of the detoning rolls 114 and 120 respectively therein. Within these recesses, and removed from cleaning brush 100, are located blade and auger arrangements for the chiseling removal of toner from the detoning rolls and movement of the toner to a storage area or to the developing station. Further structure associated with and operation of the detoning rolls 114, 120 is discussed in U.S. Pat. No. 4,819,026 to Lange et al., the pertinent portions of which are incorporated herein by reference.

Figure 2:
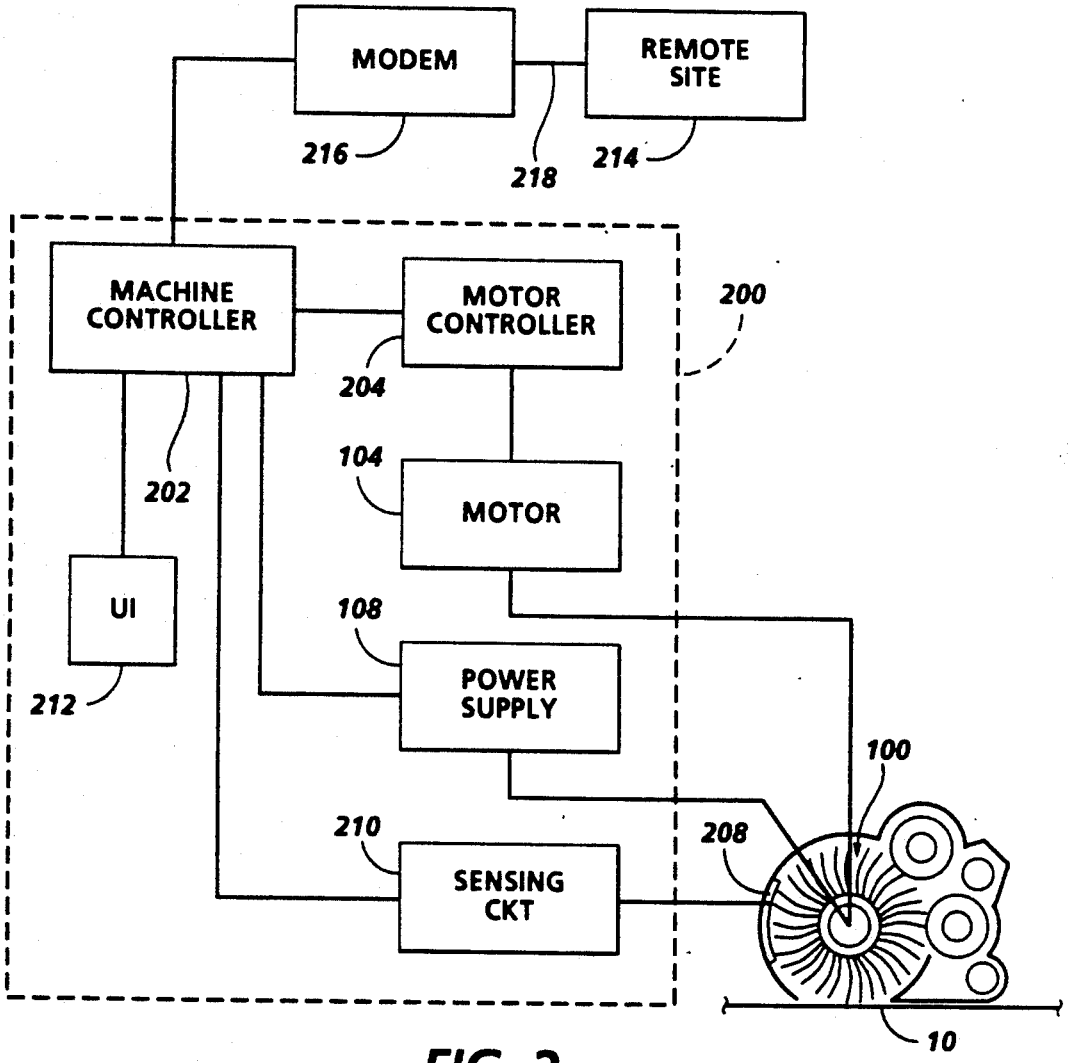
FIG. 2 is a schematic, block diagramatic view of a circuit used in conjunction with the cleaning apparatus of FIG. 1.

Referring to FIG. 2, a control circuit for use with the cleaning brush 100 is designated by the numeral 200. The cleaning brush 100 is coupled with both the motor 104 and the D.C. Power Supply 108. The D.C. Power Supply 108 is coupled with a machine controller 202 in a known manner, such as by way of an A/D converter (not shown), while the motor 104 is coupled with a motor controller 204. The motor controller 204 communicates with the machine controller 202 so that the current drawn by the motor 104 can be continuously monitored at the machine controller 202. Alternatively, the machine controller 202 could communicate with the motor 104 to monitor current drawn thereby. Preferably, the motor controller 204 includes an appropriate sensing device (not shown), such as a sensing field effect transistor ("sensing FET"), to determine the current drawn by the motor. By determining the current drawn by the motor 104, it is, as explained in further detail below, possible to determine the level of torque, and hence wear, to which the brush 100 is subjected.

Figure 2A:
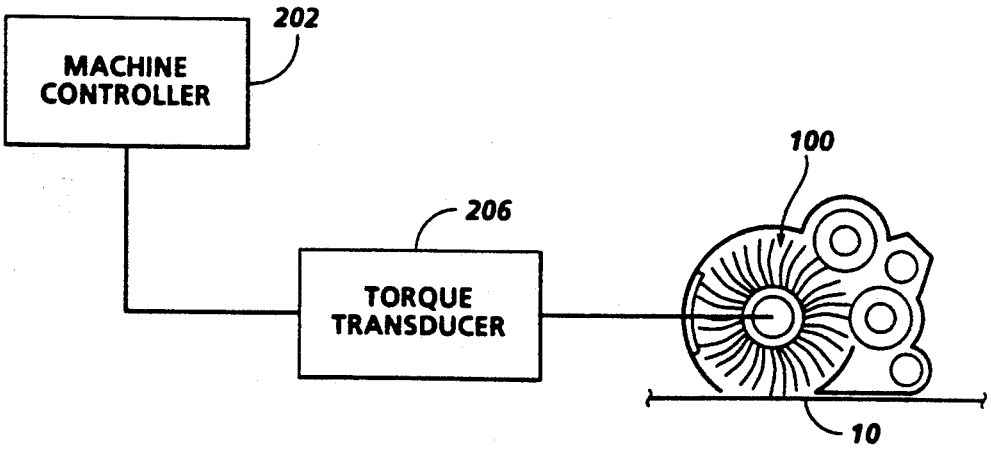
FIG. 2A is a fragmentary view of FIG. 2 with a device for measuring brush torque disposed intermediate of a brush and a machine controller.

In another aspect of the disclosed embodiment, torque of the brush can be sensed by a transducer 206 (FIG. 2A), the transducer 206 being operatively coupled with the brush 100. As will be appreciated by those skilled in the art, in one example, the transducer 206 could be mounted between a rotating shaft of the brush 100 and a solid mounting point. In another example, the transducer 206 could be mounted between the drive shaft of the motor 104 and the motor housing. In the illustrated embodiment of FIG. 2A, variations in torque measurements obtained with the transducer 206 are continuously monitored with the machine controller 202.

Referring again to FIG. 2, a surface 208 is mounted in contacting relationship with the brush 100, and the current across the contacting surface, which varies as a function of wear on brush 100, can be continuously monitored by the machine controller 202. The contacting surface 208 is interfaced with the machine controller by employment of a current sensing circuit 210, the current sensing circuit 210 being adapted to sense the level of current being delivered to the brush 100 from the D.C. power supply 108. While the sensing circuit 210 is shown as separate from the power supply 108, it is contemplated that the sensing circuit 210 could be coupled directly with the power supply 108. In the illustrated embodiment of FIG. 2, the contacting surface 208 is not in communication with the charge retentive surface of the belt 10, so that electrical fluctuations in the belt 10 do not generate error in current sensing of the contacting surface 208.

Machine controller 202 is preferably a known programmable controller or combination of controllers, which conventionally control all the machine steps and functions described. Controller 202 is responsive to a variety of sensing devices to enhance control of the machine and also provides connection of diagnostic operations to a user interface 212 where required. A machine controller which is capable of performing all of the necessary functions of the machine controller 202 is disclosed in Federico et al., U.S. patent application Ser. No. 4,475,156, the pertinent portions of which are incorporated herein by reference.

The reproduction machine can employ Remote Interactive Communications (RIC) to enable the transfer of selected machine operating data, such as a current associated with either the brush 100, the motor 104 or the power supply 108, to a remote site 214 by use of a modem 216 and a suitable communication channel, such as a telephone line 218. In one example the remote site 214 comprises a service site such as the one described in U.S. Pat. No. 5,057,866 to Hill Jr. et al., the pertinent portions of which are incorporated herein by reference. The machine operating data may be transmitted to the remote site 214 automatically at predetermined times and/or in response to a specific request from the remote site 214.

In the preferred form of operation, wear on the brush 100 is measured by one of three approaches. It will be appreciated by those skilled in the art that while a brush has been shown as the preferred means for removing residual toner from the charge retentive surface of belt 10, other rotatable members, such as a foam roller, could be used in place of brush 200 without altering the concept underlying the present invention. The first and second approaches take advantage of the observation that torque of the brush 100 changes with wear and that such changes in torque, in terms of current, can be measured, absolutely or relatively, at the machine controller 202. In the first approach, the torque of the motor 104, i.e. the amount of the current drawn by the motor 104, varies in accordance with the degree to which the brush 100 is subjected to torque or wear. That is, as the bristles 110 on the brush set, the zone of contact or interference between the brush 100 and the charge retentive surface of the photoreceptor belt 10 decreases, so that torque on the brush 100 decreases and less current is drawn by the motor 104. This decrease in torque is illustrated in the following Table 1:

TABLE 1

| Brush Configuration (Note: torques measured at lab ambient) | Torque with 2 mm brush to P/R interference (Nominal case) | Torque with 1 mm brush to P/R interference (Threshold for poor cleaning) |
|---|---|---|
| .045 μm diameter fibers, 12.4 mm pile height, 30k fibers/in$^2$ 480 rpm, against direction, 60 mm diameter brush | 10.8 oz-in | 7.2 oz-in |
| .045 μm diameter fibers, 7.0 mm pile height, 40k fibers/in$^2$, 480 rpm, against direction, 60 mm diameter brush | 48 oz-in | 39 oz-in |

TABLE 1-continued

| Brush Configuration (Note: torques measured at lab ambient) | Torque with 2 mm brush to P/R interference (Nominal case) | Torque with 1 mm brush to P/R interference (Threshold for poor cleaning) |
|---|---|---|
| 480 rpm, against direction, 60 mm diameter brush | | |

Since current drawn by the motor 104 varies as a function of the wear or torque on the brush, current levels of the motor 104 can be sensed and measured by use of the control circuit 200 to determine wear information regarding the brush 100.

To use the circuit 200 for monitoring the brush 100 in the first approach, a new brush 100 is installed initially and rotated by use of the motor 104. As the brush 100 is rotated, the amount of initial current drawn by the motor 104 is measured by the machine controller 202 and shown on a display, such as a hand-held measuring device or the user interface 212. Preferably, the machine controller 202 is programmed initially to convert the initial current level to a suitable reference or threshold level, such as zero. Fluctuations in the environment of the brush 100, such as change in humidity or temperature, can result in structural variations in the brush 100, such as variation in brush modulus. Thus, it is desirable to set the reference in view of an environmental sensing device, such as an RH sensor.

In one example of operation, the reference is set on a counter in the machine controller 202, and as the brush 100 wears, the count progresses up or down. In turn, the count can be converted to a percentage wear value, or the like, by use of a look-up table, and displayed on the user interface 212 or at the remote site 214. Additionally, the count can be stored in memory for subsequent use. As can be appreciated by those skilled in the art, one of a host of logical devices in the machine controller 202 can be used to continuously, digitally monitor the change in drawn current, and thus the wear on the brush 100. As will be also be appreciated by those skilled in the art, current measuring devices other than those of the machine controller 202 could be used to monitor current levels of the motor 104. For example, an ammeter or a bridge circuit could be used in place of the machine controller 202 to monitor the current drawn by the motor 104.

Torque on the brush 100 can decrease for reasons other than wear. For example, the belt could be subjected to "filming" and thus become insulative. When the belt 10 becomes filmed, the current measured at the machine controller 202 is not accurately representative of the condition of the brush. To avoid obtaining a false representation regarding brush wear, measured current levels of the motor 104 can be compared to a copy count, which copy count is referenced initially to the reference level for the drawn current. Accordingly, information can be provided along with wear levels to indicate when those wear levels are affected by a factor other than bristle setting.

The second approach differs from the first approach in that torque on the brush 100 is sensed directly with the transducer 206, rather than indirectly with the current levels of the motor 104. In particular, the torque is sensed with the transducer 206 and measured at the machine controller 202. All of the above-discussed signal-processing can be used to interpret data transmitted from the transducer 206 to the machine controller 202.

The third approach takes advantage of the observation that the amount of current required to maintain the D. C. bias of the brush 100 at a preselected constant level decreases as a function of wear of the brush 100. In particular, as the brush 100 wears, less current is required for maintaining the D. C. bias at the preselected constant level. This decrease in the amount of current required to maintain D. C. bias is illustrated in the following Table 2:

TABLE 2

| Brush Configuration (Notes: currents measured at lab ambient with 200v applied to brush) | Current with 2 mm brush to P/R interference (Nominal case) | Current with 1 mm brush to P/R interference (Threshold for poor cleaning) |
|---|---|---|
| .045 μm diameter fibers, 12.4 mm pile height, 30k fibes/in$^2$ 480 rpm, against direction, 60 mm diameter brush | 8.5 μA | 6.2 μA |
| .045 μm diameter fibers, 7.0 mm pile height, 40k fibers/in$^2$, 480 rpm, against direction, 60 mm diameter brush | 22 μA | 12 μA |

It is believed that such decrease is due to a change in impedance of the contact zone as a result of brush wear. That is, the contact resistance of the brush increases as the bristles 110 set. In the third approach, the current required by a new brush 100 to maintain the preselected D. C. bias is sensed by use of the contacting surface 208 and the sensing circuit 210. As the brush interferes with the contacting surface 208, a voltage is established, and a resulting current can be sensed at the current sensing circuit 210. It should be recognized that the area of the contacting surface 208 should be great enough to permit sensing of any substantial changes in the zone of contact of the brush 100. The sensed current is transmitted from the sensing circuit 210 to the machine controller 202 where all of the above-discussed signal-processing can be used to interpret data transmitted from the sensing circuit 210 to the machine controller 202.

Now that the preferred embodiment of the invention has been described with a reasonably sufficient amount of detail, numerous features will be appreciated by those skilled in the art.

One feature of the present invention is that actual wear on the brush can be continuously monitored. Consequently, the brush can be replaced when it has actually worn out rather than after a predetermined number of copies have been made.

Another feature of the present invention is that it promotes customer satisfaction with the cleaning process. In particular, the brush cannot fail without detection simply because the life of the brush did not happen to correspond with an arbitrary copy count. Indeed, the invention will save money for those situations in which the brush can be replaced later than expected because of the advantageous monitoring technique of the present invention.

Yet another feature of the present invention is that it provides a monitoring arrangement that is implemented with great ease. The circuit for monitoring brush wear efficiently employs pre-existing machine components to provide a cleaning apparatus that is optimally reliable. In accordance with the circuit, information regarding actual wear on the brush can be displayed conveniently on a user interface or at a remote site from the machine.

Yet another feature of the present invention is that it provides redundancy in measurements to insure the reliability of output regarding brush wear. For example, monitoring of brush wear can be achieved by simultaneously measuring the current delivered to the brush and the torque on the rotating brush. Additionally, the wear related measurements can be viewed relative to a copy count to determine when current measurements are partially affected by phenomena other than wear, such as photoreceptor filming.

What is claimed is:

1. In a printing apparatus having a charge retentive surface upon which a latent image is developed with developer material and transferred, leaving residual material on the charge retentive surface, an apparatus for cleaning residual material from the charge retentive surface, comprising:

a cleaning brush having a plurality of bristles, the bristles contacting the charge retentive surface and removing a portion of the residual material therefrom;

means, coupled with said rotatable member, for rotating said rotatable member;

means for transmitting an electrical signal to said rotating means; and means for monitoring the electrical signal and determining when the electrical signal has dropped below a preselected reference level so that, in response to the drop in the signal, a brush replacement signal is provided to indicate that the bristles have been worn to the extent that they can no longer adequately remove residual material from the charge retentive surface.

2. The cleaning apparatus of claim 1, wherein said rotating means comprises a motor.

3. The cleaning apparatus of claim 2, wherein:

the electrical signal comprises a current; and said transmitting means comprises a motor controller, coupled with said motor, for transmitting the current to said motor.

4. The cleaning apparatus of claim 2, wherein:

the electrical signal comprises a current; and said monitoring means comprises a measuring device, communicating with said motor, for detecting the level of current being transmitted to said motor.

5. The cleaning apparatus of claim 4, wherein said measuring device comprises a central processing unit.

6. The cleaning apparatus of claim 4, further comprising a remote interactive communications network across which information regarding the the wear on said rotatable cleaning member can be transmitted, said network coupling said measuring device with a remote site.

7. In a printing apparatus having a charge retentive surface upon which a latent image is developed with developer material and transferred, leaving charged residual material on the charge retentive surface, an apparatus for cleaning residual material from the charge retentive surface, comprising:

a conductive cleaning member disposed proximate the charge retentive surface;

a power supply, coupled with said conductive cleaning member, for transmitting an electrical signal to said conductive cleaning member for generating an electrostatic field in said rotatable conductive member to remove the charged residual material from the charge retentive surface; and means for monitoring the electrical signal transmitted to said conductive cleaning member for measuring the amount of wear to which said conductive cleaning member has been subjected.

8. The cleaning apparatus of claim 7, wherein:

said conductive cleaning member is a rotatable conductive cleaning member; and said rotatable conductive cleaning member comprises a brush having a plurality of bristles, the bristles being adapted to hold a charge for attracting charged residual material from the charge retentive surface.

9. The cleaning apparatus of claim 7, wherein the electrical signal comprises a current.

10. The cleaning apparatus of claim 9, wherein said monitoring means comprises a measuring device for detecting the level of current being supplied to said conductive cleaning member from said power supply.

11. The cleaning apparatus of claim 10, wherein said measuring device comprises a central processing unit.

12. The cleaning apparatus of claim 10, further comprising a remote interactive communications network across which information regarding the the wear on said rotatable conductive cleaning member can be transmitted, said network coupling said measuring device with a remote site.

13. In a printing apparatus having a charge retentive surface upon which a latent image is developed with developer material and charged residual material is disposed when the developer material is removed from the charge retentive surface, an apparatus for cleaning the charge retentive surface, comprising:

a cleaning brush having a plurality of bristles, the bristles contacting the charge retentive surface for removing a portion of the residual material therefrom;

a motor, coupled to said brush, for rotating said brush to mechanically remove the residual material from the charge retentive surface, said brush being characterized by a torque value which varies as a function of the wear to which the bristles have been subjected; and means for monitoring the torque value and determining when the bristles have been worn to the extent that they are no longer capable of adequately removing the residual material from the charge retentive surface.

14. The cleaning apparatus of claim 13 wherein said means for monitoring comprises a transducer capable of sensing the amount of torque to which said rotatable cleaning member is subjected.

15. The cleaning apparatus of claim 14, wherein:

said transducer is capable of generating a signal indicative of the torque value; and said monitoring means further comprises a measuring device, communicating with said transducer, for detecting the level of the signal.

* * * * *

UNITED STATES PATENT AND TRADEMARK OFFICE

CERTIFICATE OF CORRECTION

PATENT NO. : 5,229,817

DATED : July 20, 1993

INVENTOR(S) : Clark V. Lange et al.

It is certified that error appears in the above--identified patent and that said Letters Patent is hereby corrected as shown below:

Claim 1, Column 10, line 24, delete the words "rotatable member" and insert in place thereof --cleaning brush--.

Claim 1, Column 10, line 25, delete the words "rotatable member" and insert in place thereof --cleaning brush--.

Claim 6, Column 10, line 53, delete the words "rotatable cleaning member" and insert in place thereof --cleaning brush--.

Signed and Sealed this

Twenty-fourth Day of May, 1994

*Attest:*

Bruce Lehman

BRUCE LEHMAN

*Attesting Officer*

*Commissioner of Patents and Trademarks*